US008375600B2

(12) United States Patent
Adams et al.

(10) Patent No.: US 8,375,600 B2
(45) Date of Patent: Feb. 19, 2013

(54) VENTILATING FOOTWEAR DEVICES

(75) Inventors: Michael S. Adams, Oxford, PA (US); Robert J. Wiener, Middletown, DE (US); William G. Hardie, Landenberg, PA (US)

(73) Assignee: W. L. Gore & Associates, Inc., Newark, DE (US)

( * ) Notice: Subject to any disclaimer, the term of this patent is extended or adjusted under 35 U.S.C. 154(b) by 1056 days.

(21) Appl. No.: 12/142,881

(22) Filed: Jun. 20, 2008

(65) Prior Publication Data

US 2008/0313931 A1 Dec. 25, 2008

Related U.S. Application Data

(60) Provisional application No. 60/945,152, filed on Jun. 20, 2007.

(51) Int. Cl.
*A43B 7/06* (2006.01)

(52) U.S. Cl. ..... 36/3 B; 36/3 R

(58) Field of Classification Search ..... 36/3 B, 36/3 R, 29, 35 B
See application file for complete search history.

(56) References Cited

U.S. PATENT DOCUMENTS

| | | | | |
|---|---|---|---|---|
| 3,180,039 | A | 4/1965 | Burns, Jr. | |
| 4,521,979 | A | 6/1985 | Blaser | |
| 4,679,335 | A | 7/1987 | Berlese | |
| 4,813,160 | A | 3/1989 | Kuznetz | |
| 5,171,033 | A | 12/1992 | Olson et al. | |
| 5,367,788 | A | 11/1994 | Chen | |
| 5,515,622 | A | 5/1996 | Lee | |
| 5,893,219 | A | 4/1999 | Smith et al. | |
| 5,918,381 | A | 7/1999 | Landry | |
| 5,950,332 | A | 9/1999 | Lain | |
| 6,041,518 | A | 3/2000 | Polycarpe | |
| 6,079,123 | A * | 6/2000 | Clark | 36/3 B |
| 6,199,304 | B1 | 3/2001 | Ludemann | |
| 6,205,680 | B1 * | 3/2001 | Clark | 36/3 B |
| 6,281,594 | B1 | 8/2001 | Sarich | |
| 6,415,529 | B1 | 7/2002 | Kelley | |
| 2002/0170203 | A1 | 11/2002 | Sanner | |
| 2002/0174972 | A1 | 11/2002 | Ichigaya | |
| 2003/0167653 | A1 | 9/2003 | DeKalb | |
| 2004/0006889 | A1 * | 1/2004 | Chen | 36/3 R |
| 2004/0010939 | A1 * | 1/2004 | Liu et al. | 36/29 |
| 2004/0074107 | A1 | 4/2004 | Tuan | |
| 2004/0078996 | A1 | 4/2004 | Brooks | |
| 2005/0034335 | A1 | 2/2005 | Shows | |
| 2007/0094890 | A1 * | 5/2007 | Cho et al. | 36/3 R |

FOREIGN PATENT DOCUMENTS

| | | |
|---|---|---|
| BE | 890 213 | 1/1982 |
| DE | 44 34 599 | 4/1996 |
| DE | 20 2005 013490 | 3/2000 |
| FR | 2 414 887 | 8/1979 |
| GB | 2405781 A | 3/2005 |
| JP | 04 009101 | 1/1992 |
| JP | 04 009102 | 1/1992 |
| JP | 09 000310 | 1/1997 |
| WO | 2005/112679 | 12/2005 |
| WO | 2008/125524 | 10/2008 |

* cited by examiner

*Primary Examiner* — Milton Nelson, Jr.
(74) *Attorney, Agent, or Firm* — James Arnold, Jr.

(57) ABSTRACT

Ventilating insole boards, self-ventilating footwear devices and self-bailing footwear articles and devices are provided.

8 Claims, 13 Drawing Sheets

VENTILATING FOOTWEAR DEVICES

RELATED APPLICATIONS

This application claims priority to Provisional Application Ser. No. 60/945,152, filed Jun. 20, 2007.

FIELD OF THE INVENTION

The present invention relates to ventilating insole boards, self-ventilating footwear devices and self-bailing footwear articles and devices for keeping a user's feet cool and dry.

BACKGROUND OF THE INVENTION

Shoes which cool and dehumidify one's feet have been disclosed.

An example is a shoe with a product built into the sole of the shoe that cools and dehumidifies one's feet. In this example, the product is two layers molded or connected to the shoe sole, wherein the first layer has a liquid-filled area with a liquid powered turbine and the second layer contains a built-in fan or fans or other turbines powered by the liquid turbine responding to movement of the liquid in the first layer.

Athletic shoes with a self-pumping chamber for producing a continuous supply of airflow which provides ventilation to the foot of the wearer and/or improves the fit or cushioning of the shoe have also been disclosed.

Another example is an athletic shoe insulated to minimize heat from solar radiation and heat conduction from the ground and ventilated to draw into the interior of the shoe cool ambient air and discharge moist warm air developed as a result of athletic activity.

Yet another example is a shoe ventilation apparatus inclusive of a shoe with a bottom sole, a heel portion, and an upper portion, as well as pocket attached to the exterior portion of the shoe inclusive of a bellows with an air-inlet port and an air-outlet port disposed in the heel portion. All of the prior examples fail to provide adequate fluid flow around the foot to achieve wearer comfort.

SUMMARY OF THE INVENTION

The present invention relates to ventilating insole boards for use in articles of footwear to keep a user's foot inside the footwear cool and dry.

In one embodiment, the ventilating insole board of the present invention comprises a heel region, a plantar region, a joinable flange having a first circumference positioned in the heel region, a pivotable pump having a second circumference located adjacent to the joinable flange in the heel region and a hinged connection between the joinable flange and the plantar region positioned in the heel region of the ventilating insole board.

In another embodiment, the footwear insole board comprises an insole board with a heel region and a toe region and an air distribution device extending from the heel region to the toe region. In this embodiment, the heel region comprises a joinable flange, a pivotable pump located adjacent to the flange, and a hinged connection proximal to the heel region about which the pivotable pump rotates.

Another aspect of the present invention relates to a self-ventilating footwear device configured to fit substantially within a footwear article extending substantially the length of the footwear article. The self-ventilating footwear device comprises a toe region, a heel region, an insole board extending from the heel region to toe region and having at least one resilient, compressible pump having an expelled fluid volume of at least 10 ml, at least one fluid flow channel having an inlet and an outlet and extending at least from the heel region to the toe region, and at least one check valve located within the fluid flow channel between the inlet and the outlet. In this device, the inlet of the fluid flow channel is located proximal to the heel region and in fluid communication with the compressible pump so that air is drawn into a fluid reservoir connected to or integrated with the pump through the inlet upon decompression of the pump. The outlet of the fluid flow chamber of this device is located distal to the toe region so that air drawn into the compressible pump is expelled through the outlet upon compression of the pump.

Another aspect of the present invention relates to a self-bailing waterproof footwear article.

In one embodiment, the self-bailing waterproof footwear article comprises a waterproof upper region, a waterproof sole region, and a fluid distribution system having at least one inlet, at least one outlet and at least one compressible pump with a fluid reservoir connected to or integrated into the pump. The inlet and the pump with fluid reservoir of the fluid distribution system are located in the waterproof sole region while the outlet is located in the upper waterproof region to expel fluid via the pump to the external environment.

In another embodiment, the self-bailing footwear device comprises a toe region, a heel region, an insole board extending from the heel region to the toe region and having at least one compressible fluid pump having an expelled fluid volume of at least 10 ml, at least one fluid flow channel having an inlet and an outlet and extending at least from the heel region to the toe region, and at least one check valve located between the inlet and the outlet to control fluid flow direction. The inlet of the fluid flow channel is in fluid communication with the pump so that fluid is drawn into the fluid flow channel through the inlet upon decompression of the pump. The outlet of the fluid flow channel is located so that fluid is expelled from the fluid flow channel to the external environment through the outlet upon compression of the pump.

BRIEF DESCRIPTION OF THE FIGURES

FIG. 3A is a cross-sectional view of a Strobel Construction, Waterproof footwear.

FIG. 3B is a cross-sectional view of a Strobel Construction, Non-Waterproof footwear.

FIG. 3C is a cross-sectional view of a Cement Lasted Construction, Waterproof footwear.

FIG. 3D is a cross-sectional view of a Cement Lasted Construction, Non-Waterproof footwear.

FIG. 3E is a cross-sectional view of a Single-Lasted Construction, Waterproof footwear.

FIG. 3F is a cross-sectional view of a Single-Lasted Construction, Waterproof footwear.

FIG. 3G is a cross-sectional view of footwear created with direct injection to form a waterproof seal.

FIG. 3H is a cross-sectional view of a Direct Injection Non-Waterproof footwear.

FIG. 3I is a view of a Bootie Construction which is waterproof

FIG. 3J is a view of a Bootie Construction which is non-waterproof.

DETAILED DESCRIPTION OF THE INVENTION

The present invention relates to footwear as well as devices for insertion into footwear which allow for delivery of air to a region of the footwear and/or removal of fluids from the footwear.

The present invention provides ventilating insole boards for insertion into a shoe or boot.

Figure 1:
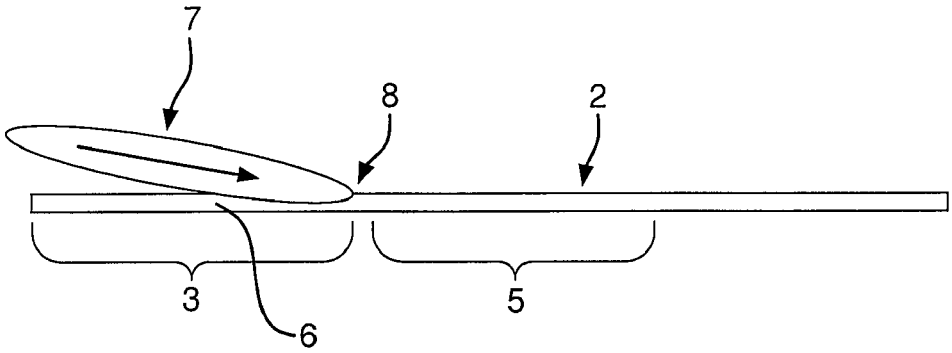
FIG. 1 is a diagram of an exemplary embodiment of a ventilating insole board of the present invention.

In one embodiment, as depicted in FIG. 1, the ventilating insole board 2 comprises a heel region 3 and a plantar region 5, a joinable flange 6 having a first circumference, a pivotable pump 7 having a second circumference and located adjacent to the joinable flange 6, and a hinged connection 8 between the joinable flange 6 and the pivotable pump. As shown in FIG. 1, the joinable flange 6 and pivotable pump 7 are located in the heel region 3 of the ventilating insole board 2 while the hinged connection 8 is between the heel region 3 and plantar region 5 of the insole board 2. In this embodiment, the first circumference of the joinable flange 6 can be smaller than the second circumference of the pivotable pump 7. Alternatively, the pump may be located in a recess in the heel of the footwear or below the insole board.

Materials which are suitable for the construction of the insole board include but are not limited to: plastics, rubbers, elastomers, polyvinylchlorides, thermoplastics, polyethylene, polypropylene, ethylene vinyl alcohol (EVA), thermoplastic polyurethane (TPU), materials which are able to be radio frequency (RF) welded, weldable materials, materials which are able to be ultrasonically (US) welded, materials which are able to be adhesively joined. Materials which are suitable for the construction of the joinable include but are not limited to: plastics, rubbers, elastomers, polyvinylchlorides, thermoplastics, polyethylene, polypropylene, EVA, TPU, materials which are able to be radio frequency (RF) welded, weldable materials, materials which are able to be ultrasonically (US) welded, or other materials which are able to be adhesively joined. The pivotable pump may be formed of one part or multiple parts. Materials used in the formation of the pivotable pump include but are not limited to plastics, rubbers, elastomers, polyvinylchlorides, thermoplastics, polyethylene, polypropylene, EVA, TPU, materials which are able to be radio frequency (RF) welded, weldable materials, materials which are able to be ultrasonically (US) welded, materials which are able to be adhesively joined, other materials suited to construct a compressible pump body. The hinged connection may be formed from welding or adhering the pump to the insole board.

Figure 2:
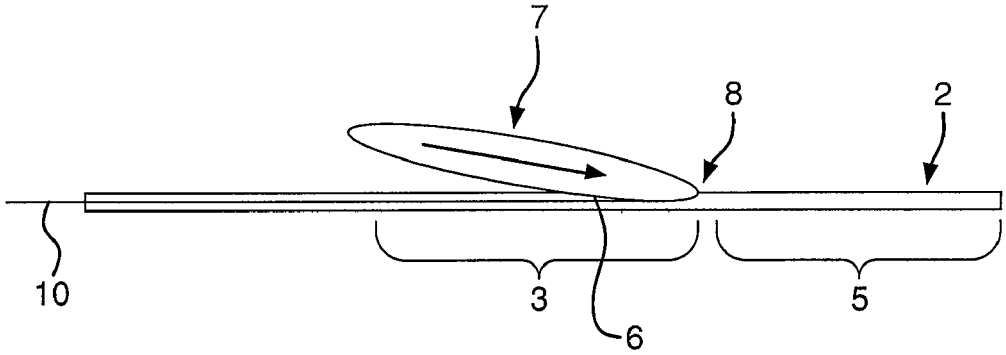
FIG. 2 is a diagram of an alternative exemplary embodiment of a ventilating insole board of the present invention with an air distribution device. The diagram illustrates a hinged connection proximal to heel region, as opposed to between the heel and plantar regions, and the air distribution device.

As depicted in FIG. 2, the footwear insole board may further comprise an air distribution device 10 extending from the at least the heel region 3 of the insole board 2 to about the toe region 4 of the insole board. In this embodiment, the joinable flange 6 and pivotable pump 7 located adjacent to the joinable flange 6 are positioned in the heel region 3 and have a hinged connection 8 proximal to the heel region 3 about which the pivotable pump 7 hingedly rotates. The air distribution device 10 of this embodiment preferably has an expelled volume of at least 10 ml, more preferably at least 20 ml. The air distribution device may be comprised of fluid channels which are connected to the pivotable pump.

The present invention also provides self-ventilating footwear devices.

FIGS. 3A-3J show aspects of an exemplary self-ventilating footwear device of the present invention comprising a toe region 4, a heel region 3, an insole board 2 which extends from the heel region 3 to the toe region 4 of the footwear device, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 14 between the inlet 15 and the outlet 16. It is to be noted that the fluid flow channel 14 may be integrated into either the insole board or the strobel board or may exist independent of either.

Figure 3A:
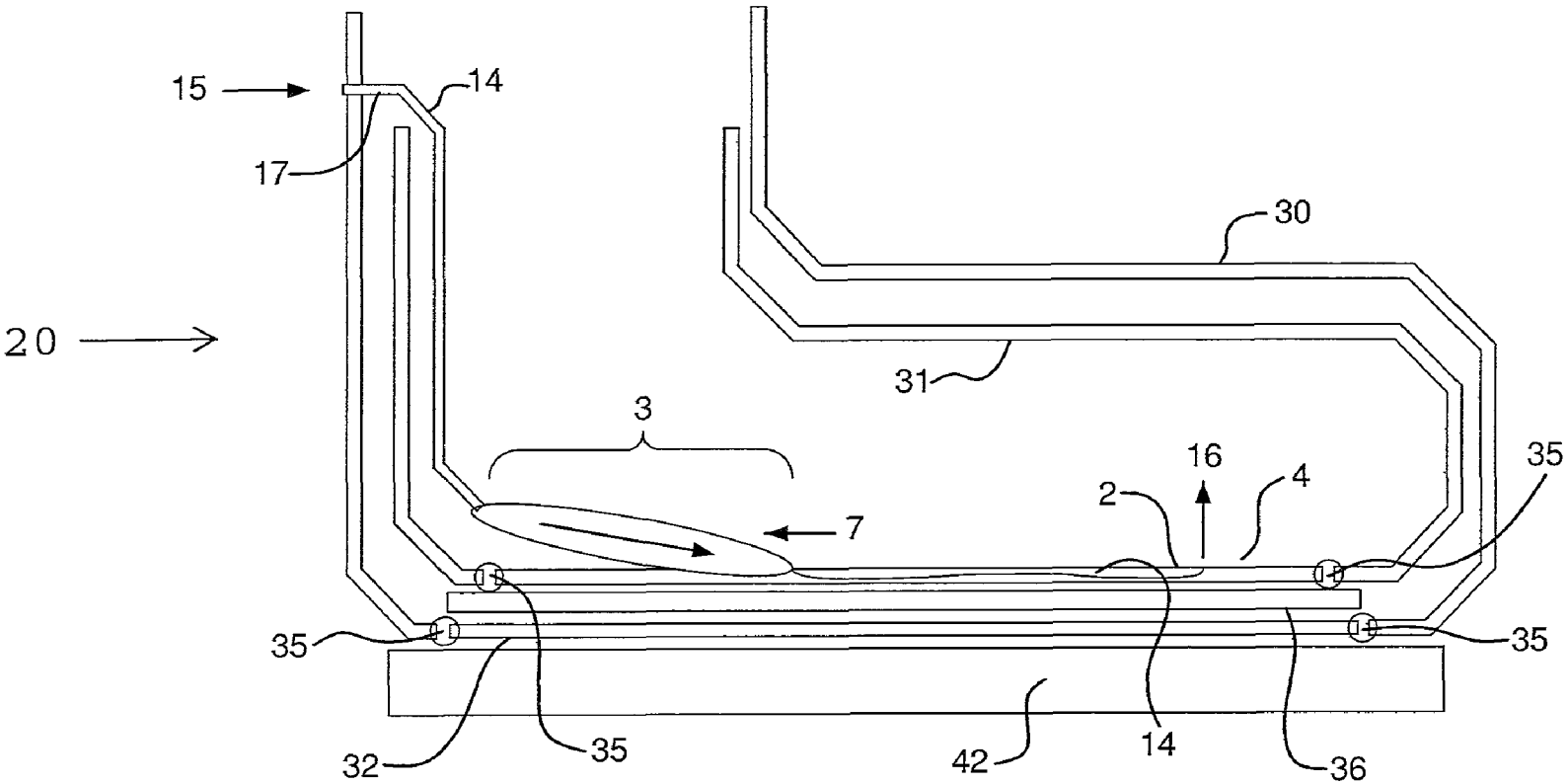
FIGS. 3A-3J are cross-sectional views of self-ventilating footwear device fitted into footwear articles. The embodiments shown include.
Figure 3B:
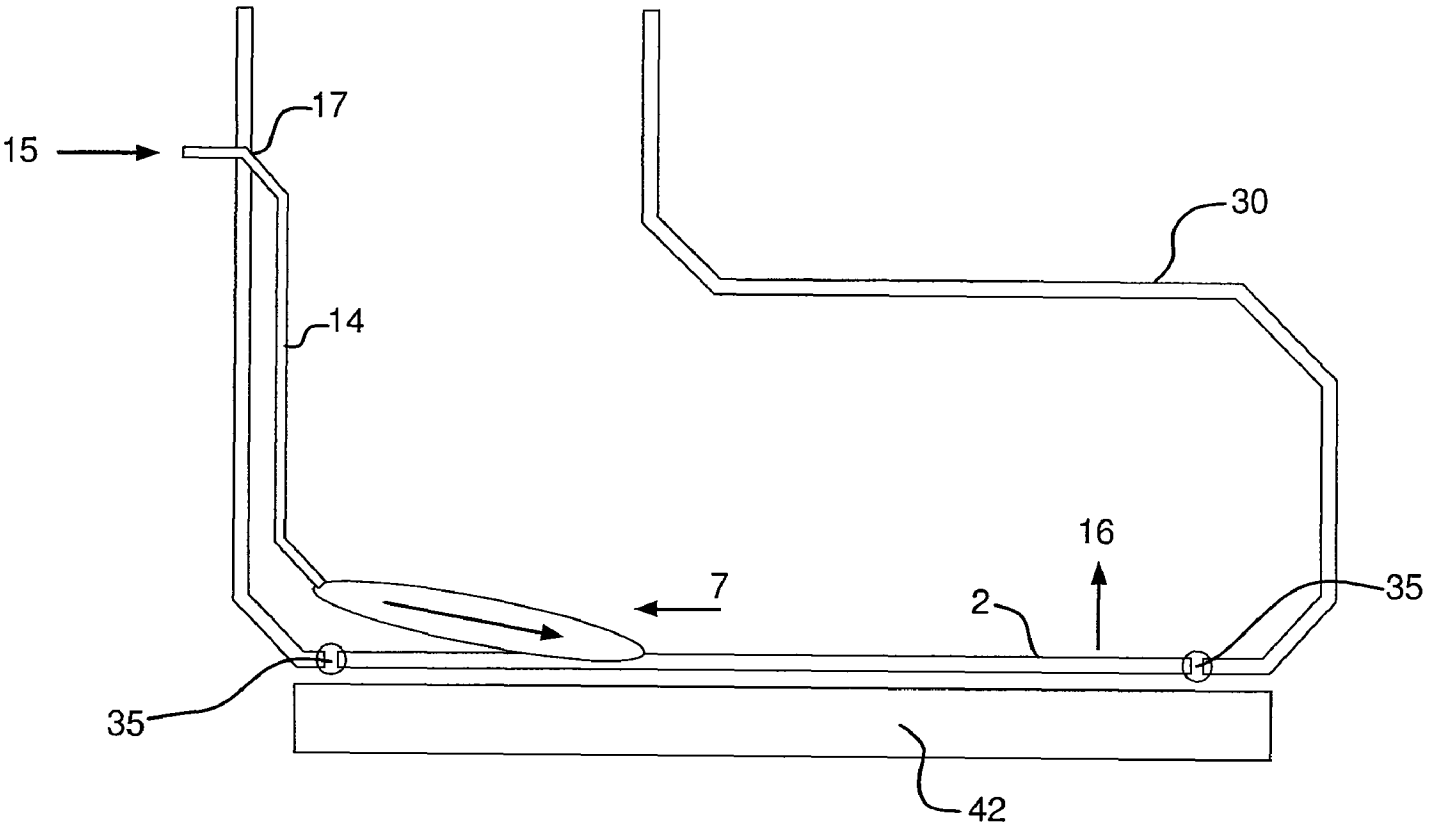

In FIGS. 3A and 3B, the footwear comprises a upper including at least a waterproof, water vapor permeable functional layer and an outer layer laminated thereto. The upper 30 is connected via stitches 35 to a strobel board to form a closed upper having an inner surface, an outer surface, an open top, and a closed bottom. A waterproof gasket material 36 is adhered to the inner surface of the closed bottom of the closed upper, covering the strobel board, the stitching and at least a perimeter edge of the upper. In this embodiment, the insole board is connected to the lining 31 which allows the lining to be conformed to a desired form. A sole 42 may then be added. FIG. 3B is a cross-sectional view of a strobel construction which is similar to FIG. 3A, but does not require a lining. In this embodiment the insole board may be connected directly to the upper forming a non-waterproof shoe or boot.

Figure 3C:
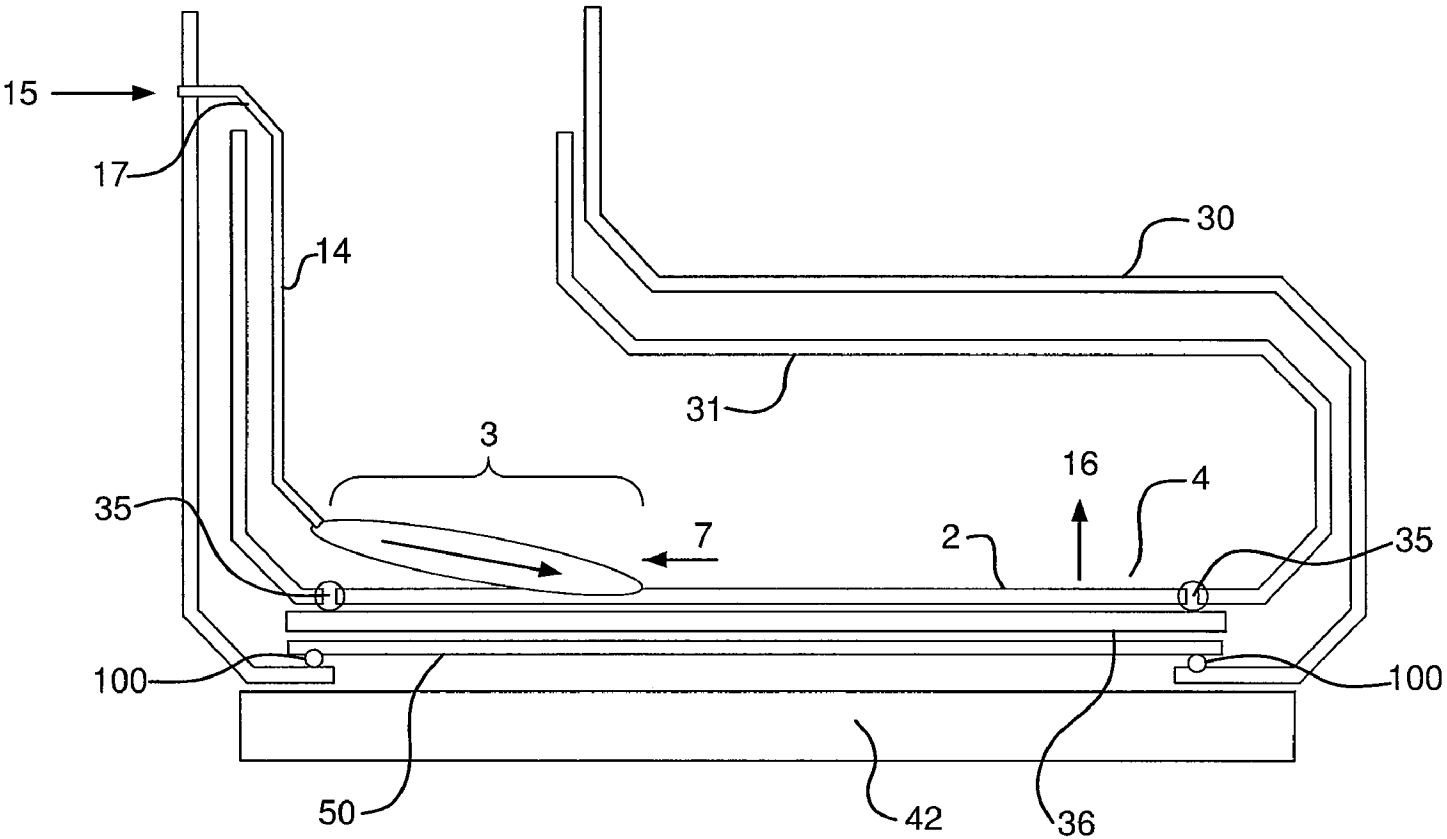
Figure 3D:
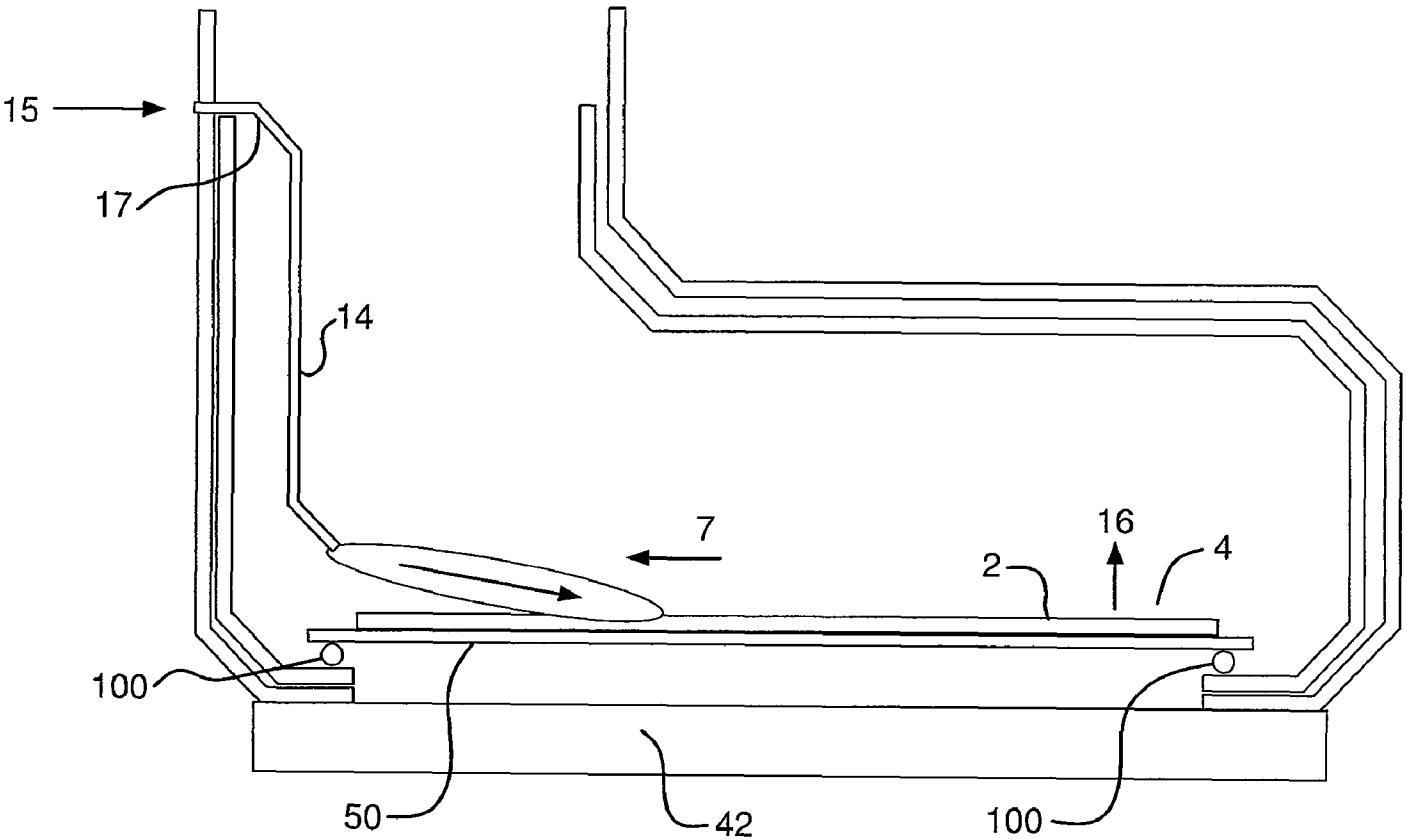

FIGS. 3C and 3D show a cross-sectional view of cement lasted footwear construction. FIG. 3D is a cross-sectional view of a cement lasted construction which is waterproof and comprising a toe region 4, a heel region 3, an insole board 2 which extends from the heel region 3 to the toe region 4 of the footwear device, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 14 between the inlet 15 and the outlet 16. In FIG. 3C, the lasting board 50 is adhered via adhesive 100 to the upper 35 forming a construct located above the sole 42. In FIG. 3D the upper 30 is bonded to the lining 31. The lasting board 50 is adhered directly to the lining 31 via an adhesive 100, and a sole is then added in contact with the lasting board.

Figure 3E:
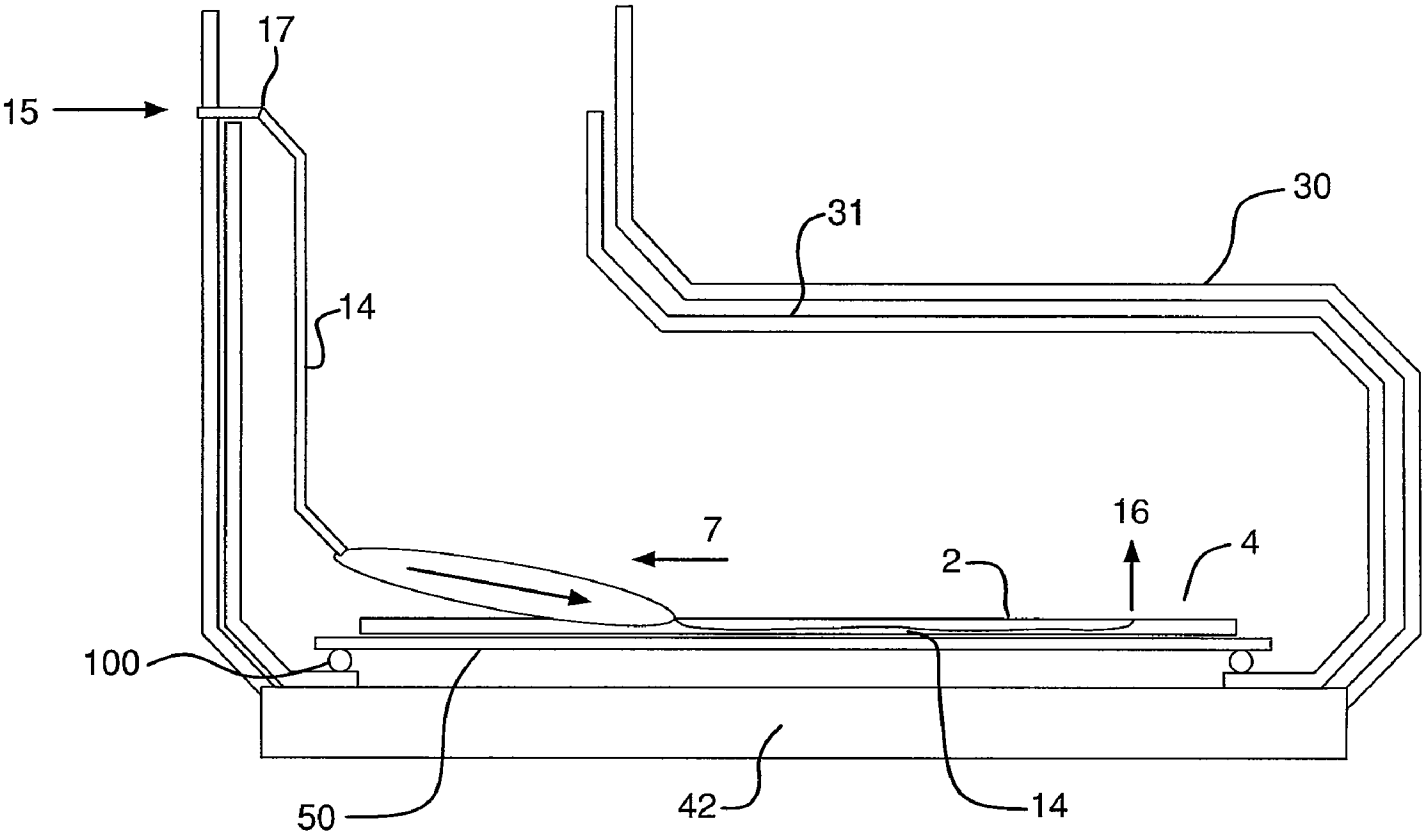

FIG. 3E is a cross-sectional view of a single-lasted construction which is waterproof and comprises a toe region 4, a heel region 3, an insole board 2 which extends from the heel region 3 to the toe region 4 of the footwear device 20, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 14 between the inlet 15 and the outlet 16. An extruded polymer 102 is used to join the edge of the lining to the lasting board and form a seal. This embodiment enables simplified manufacturing processes by filling spaces with extruded polymers as shown and also fills sole 42 openings or cavities.

Figure 3F:
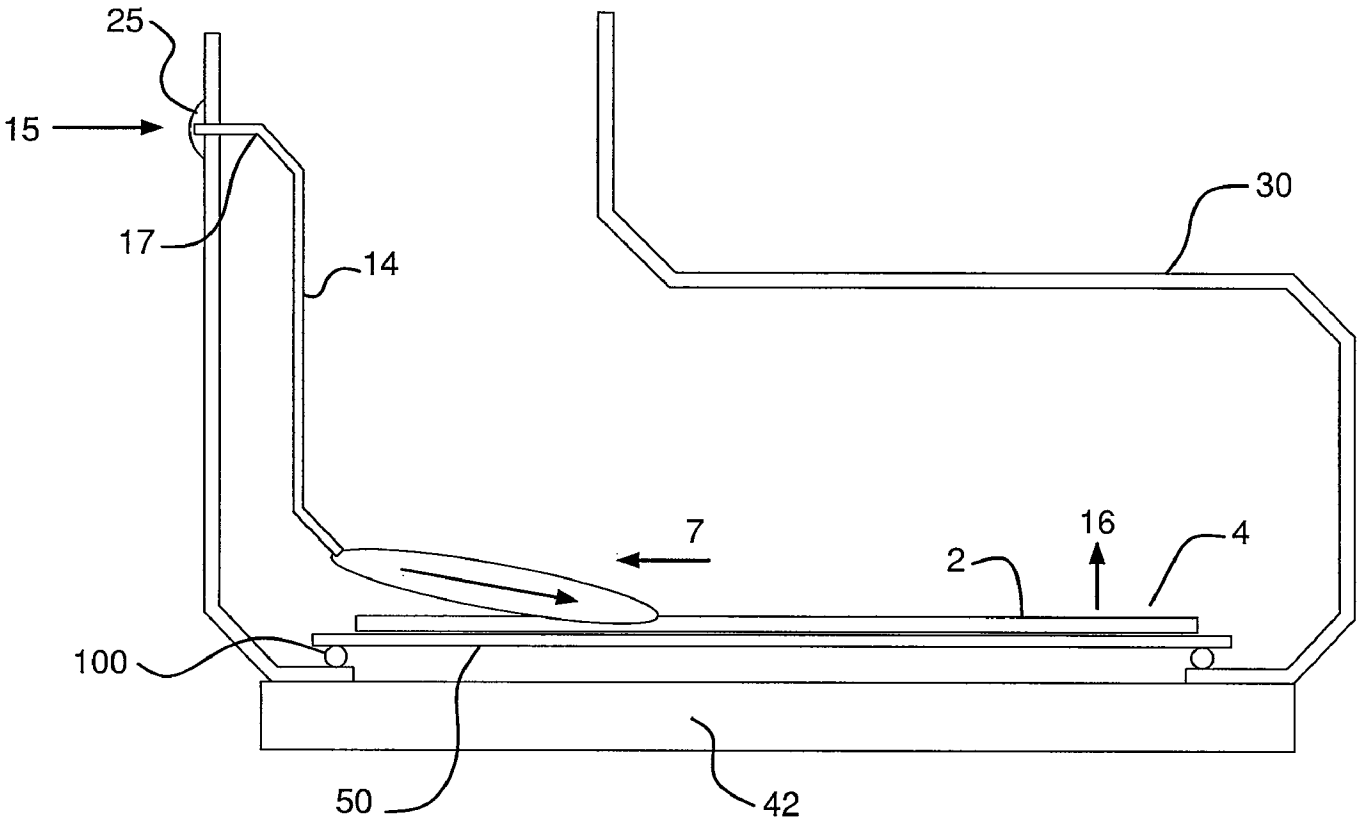

FIG. 3F is a cross-sectional view of a single-lasted footwear construction which is waterproof and comprises a toe region 4, a heel region 3, an insole board 2 which extends from the heel region 3 to the toe region 4 of the footwear device 20, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 14 between the inlet 15 and the outlet 16. The edge of the upper 30 is joined to the lasting board and forms a seal via cement or adhesive 100.

Figure 3G:
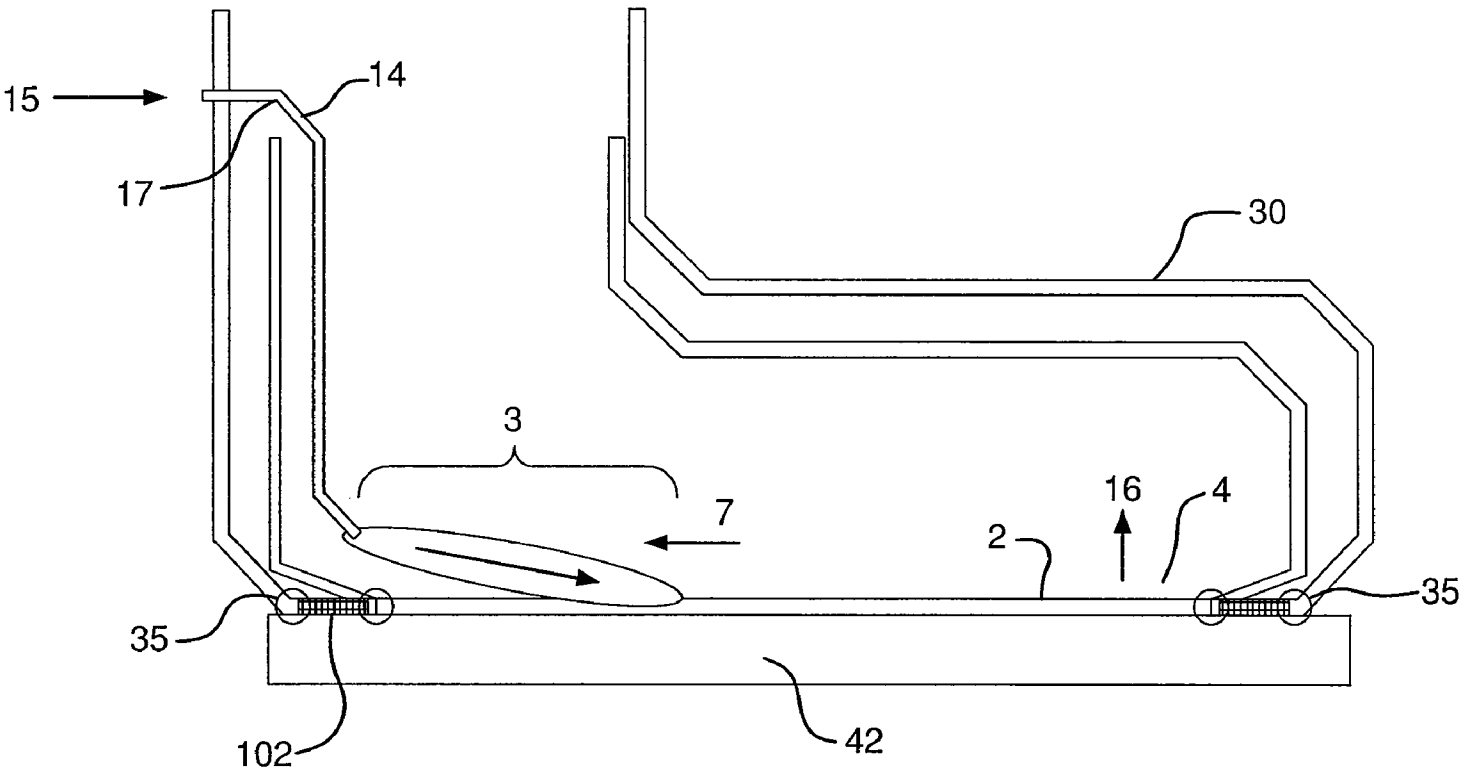

FIG. 3G is a cross-sectional view of a direct injection shoe with a waterproof lining 31. This embodiment is comprising a toe region 4, a heel region 3, an insole board 2 which extends from the heel region 3 to the toe region 4 of the footwear device 20, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 14 between the inlet 15 and the outlet 16. A net band 102 allows the sole to be attached to the insole board 2 without the need for any added material between the insole board and the sole, leading to more flexibility and the option of making the shoe lighter weight and increased cushioning. The net band 102 may be held in place by stitches 35. The net board may also join the upper 30 to the lining 31.

Figure 3H:
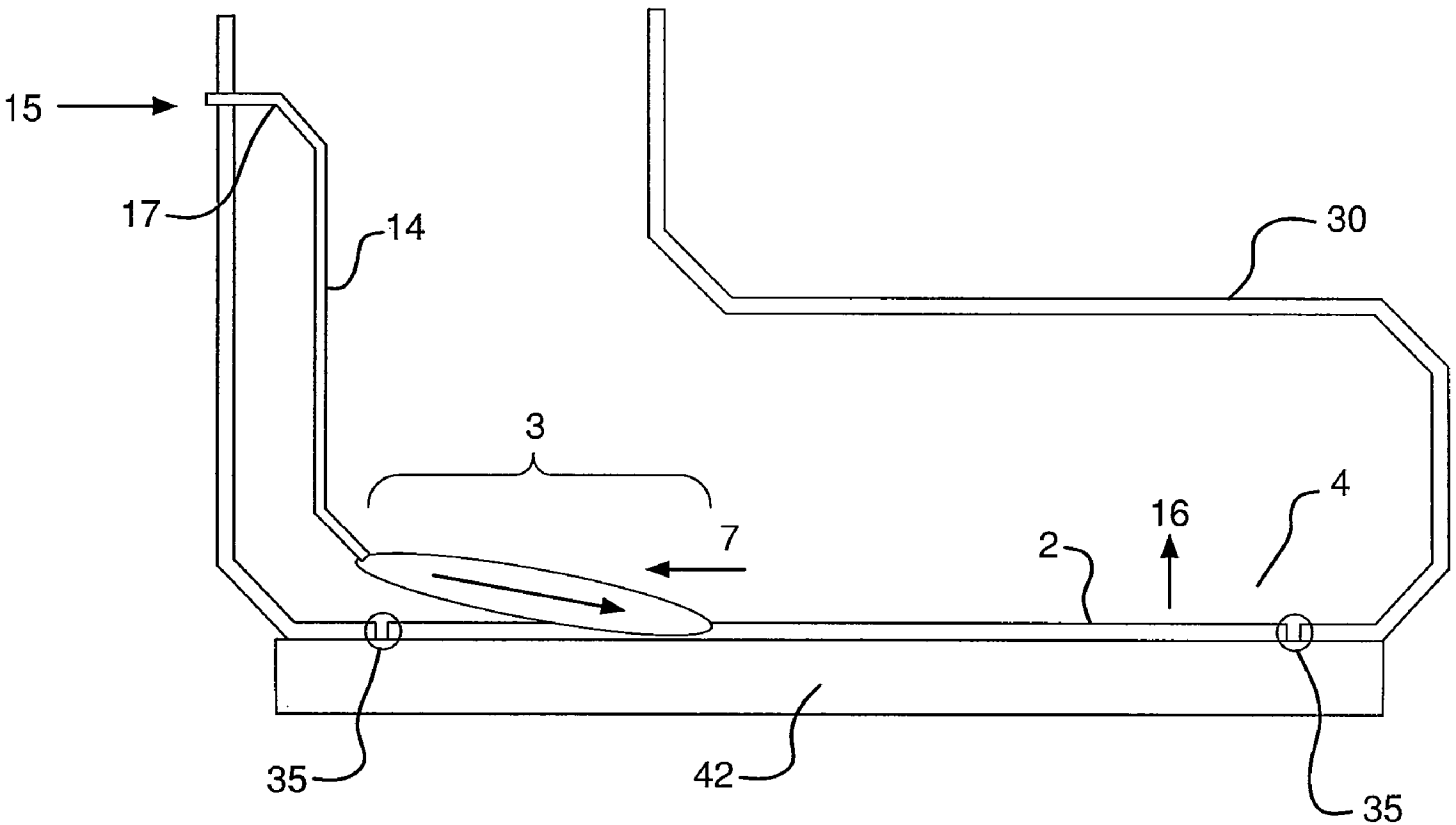

FIG. 3H is a cross-sectional view of a direct injection non-waterproof. This embodiment is comprising a toe region 4, a heel region 3, an insole board 2 which extends from the heel region 3 to the toe region 4 of the footwear device at least one resilient, pivotable pump 7, at least one fluid flow channel 14 having an inlet 15 and an outlet 16 which also extends from the heel region 3 to the toe region 4 of the footwear device, and at least one check within the fluid flow channel 14 between the inlet 15 and the outlet 16. The pivotable pump may be hollow or may comprise a center filler material to aid in shape retention or comfort. The insole board 2 is connected to the upper 30 via stitches 35 or other affixing means. The sole 42 is directly injected to the insole board 2.

Figure 3I:
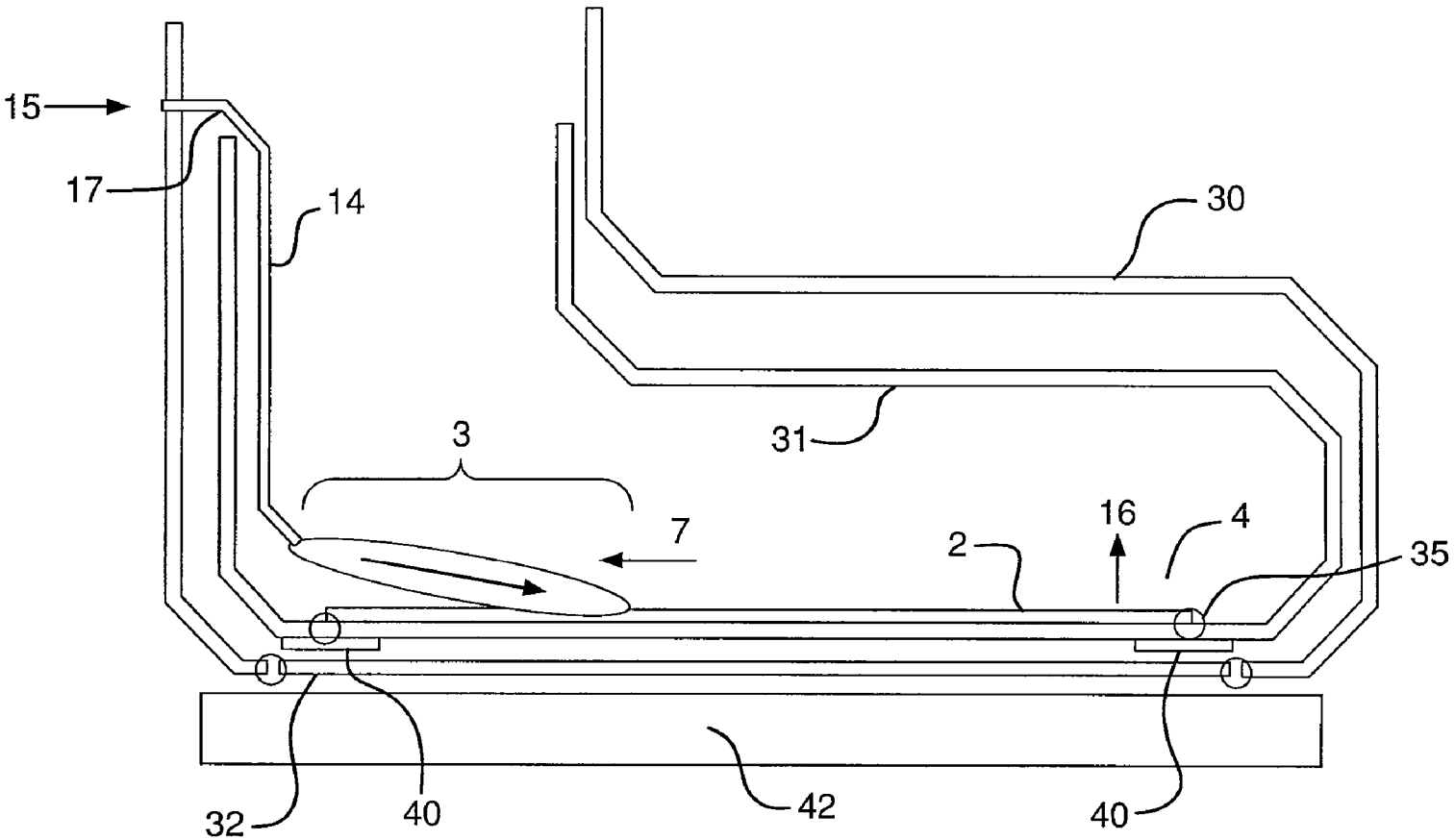
Figure 3J:
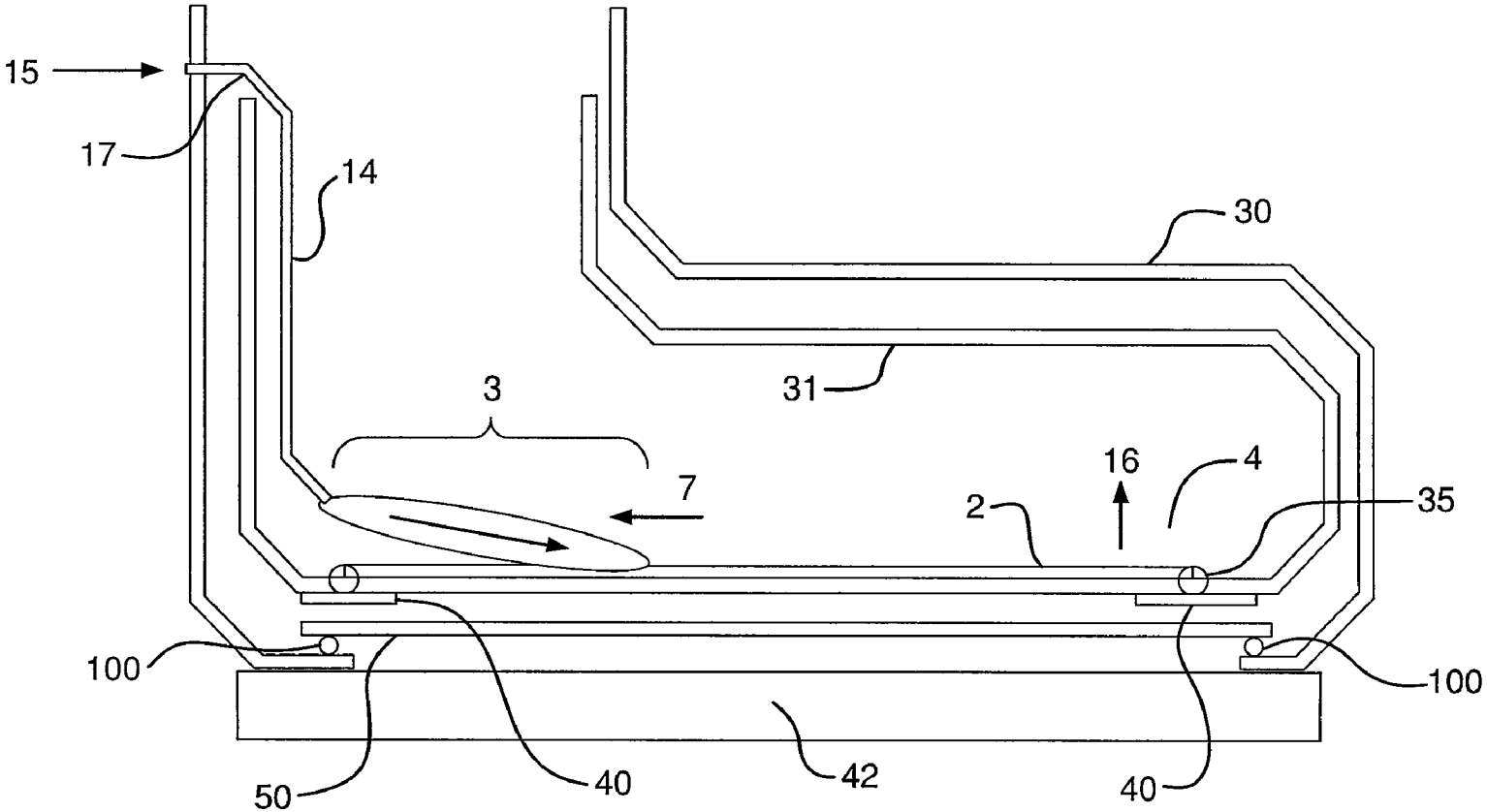

FIGS. 3I and 3J show bootie type construction. FIG. 3I shows a bootie construction with a strobel board 32 used above the sole 12. This aspect of the invention allows the footwear to have a bootie like construct and waterproof features. This aspect comprises a toe region 4, a heel region 3, an insole board 2 which extends form the heel region 3 to the toe region 4 of the footwear device 20, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 4 between the inlet 15 and the outlet 16. The insole board 3 is able to be connected via stitches 35 to the lining 31 and a seam tape 40 is able to be applied over the seams and make the stitched seams waterproof. The insole board 2 is then able to be located directly under the foot of a wearer. The upper 30 is attached as shown via stitches to the strobel board to form an outer shell surrounding the lining 31 and pump construct. The sole 12 is able to be either injection molded, glued or otherwise attached to the upper and strobel board construct.

FIG. 3J shows a bootie construction which is non-waterproof and comprises a toe region 4, a heel region 3, an insole board 2 which extends from the heel region 3 to the toe region 4 of the footwear device, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 14 between the inlet 15 and the outlet 16. An extruded polymer or adhesive 100 is used to join the edge of the upper to a lasting board 50 and form a seal. A lasting board 50 is used to provide a shape to the shoe. The lasting board 50 may be secured between the upper 30 and the lining 31.

The upper can be a textile fabric or leather. Textile fabrics used in the embodiments can be woven, knit, mesh, non-woven, felt constructions, etc. Textiles can be produced from natural fibers such as cotton, or from synthetic fibers such as polyesters, polyamides, polypropylenes, polyolefins, or blends thereof. The upper is relatively durable, abrasion resistant and provides an aesthetically pleasing appearance.

The inlet 15 of the fluid flow channel 14 is located proximal to the heel region 3 and in fluid communication with the pump 12 so that air is drawn into the pump 12 through the inlet 15 upon decompression of the pump 12. In some embodiments the inlet of the fluid flow channel may have an inlet cover 25 which fits over the inlet to keep debris and water from entering into the flow channel, see for example, FIG. 3F. The inlet cover also protects the durability of the pump by providing a protective cover against water or debris entry into the channel. In another aspect the inlet cover may be configured so that the fluid flow channel may be shut off via a plug, screw or other means of closing the air flow channel.

The outlet 16 of the fluid flow channel 14 is located in the toe region or distal to the toe region 4 for air drawn into the pump 12 to be expelled through the outlet 16 of the fluid flow channel 14 upon compression of the pump. The outlet may comprise a single opening or a plurality of openings.

The pump of the self ventilating footwear device expels fluid, preferably air, at a volume of at least 10 ml, more preferably at least 20 ml. It is expected that the relative humidity will decrease by about fifteen percent when at least 10 ml of air is able to be expelled. Preferably, the compressible pump used in the present invention withstands and delivers at least 10 ml of expelled air per step after at least 250,000 compressions in one embodiment and of at least 500,000 compressions in other desired embodiments. In some embodiments of this footwear device, the compressible pump is comprised of at least two dissimilar materials such as those listed in the preceding description. It is preferred that the pump used in the footwear device of the present invention have an efficiency rating of at least 50%, preferably at least 60%, more preferably at least 75%.

The self-ventilating footwear device is configured to fit inside a footwear article and extend substantially the length of the footwear article.

Figure 4:
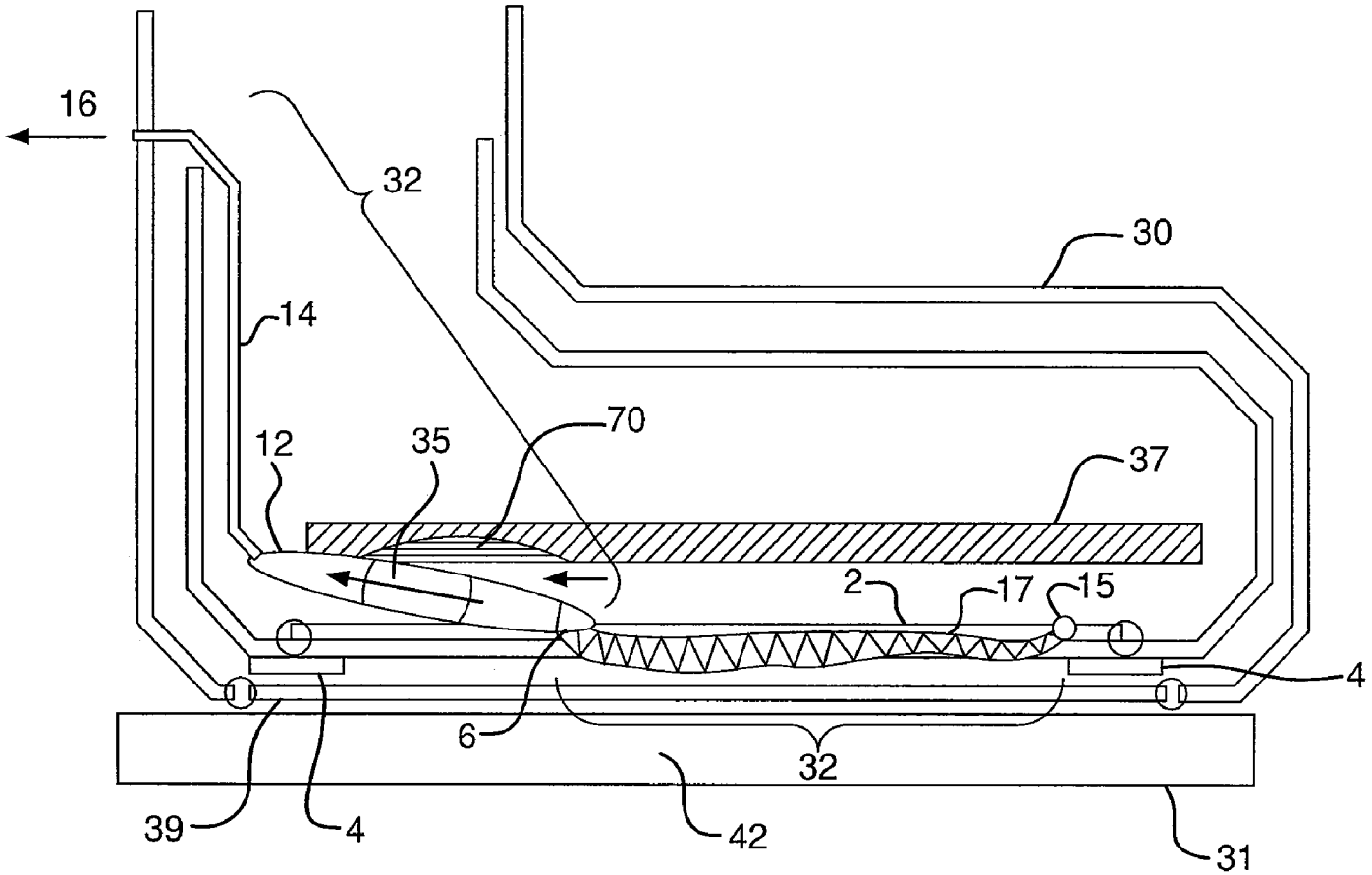
FIG. 4 is a diagram of an exemplary self-bailing waterproof footwear article with a preformed cavity for fluid collection.

Further provided in the present invention are self-bailing waterproof footwear articles. An exemplary self-bailing waterproof footwear article is depicted in FIG. 4 As shown therein, the self-bailing waterproof footwear article comprises a waterproof upper region 30, a waterproof sole region 31, and a fluid distribution system 32.

The fluid distribution system 32 has at least one inlet 15 connected to at least one compressible pump 12 connected to or integrated with a fluid reservoir 35, all located in the waterproof sole region 31, a check valve 17 located between the inlet 15 and outlet 16, a flow channel 14 and an outlet 16 located in the waterproof upper region 30 which expels fluid from the footwear article to the external environment via the pump. In one embodiment, the fluid reservoir 35 has a fluid capacity of at least 10 ml, more preferably 20 ml. An optional cavity 70 may be formed around the pump for comfort or to allow fluids to collect under the footbed.

In one embodiment, the inlet is positioned under the foot of a wearer of the article, although the inlet may be located in any desirable location in which the fluid may enter.

In one embodiment, the compressible pump 12 is located under the heel of a wearer of the article, although it may be positioned elsewhere, e.g. beneath the ball of the foot.

Figure 5:
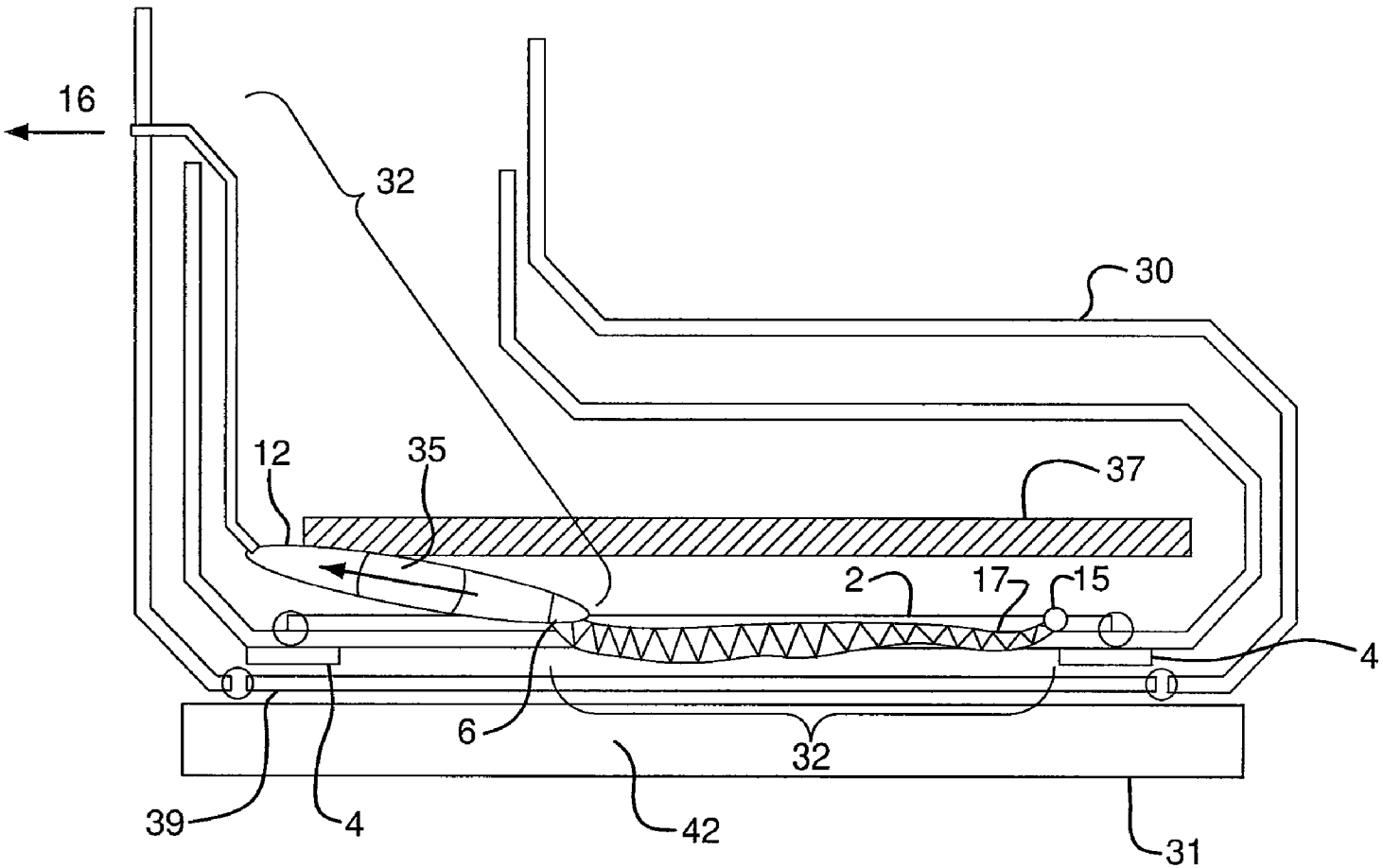
FIG. 5 is a diagram of another exemplary embodiment of a self-bailing waterproof footwear article where the waterproof sole region further comprises a footbed, an insole board and an outsole.

In one embodiment, such as depicted in FIG. 5, the waterproof sole region further comprises an optional footbed 37, an insole board 2 and an outsole 39. In this embodiment, the fluid distribution system 32 can be positioned in the footbed, the insole board or the outsole. In addition, in this embodiment, wherein the fluid distribution system 32 is positioned in the insole board 2, the insole board may further comprise an insole with a heel region 3 and a toe region 4, and a joinable flange 6 so that the fluid distribution system 32 can extend essentially between the heel region 3 and the toe region 4 and the joinable flange 6 can extend from a mid-point on the insole board 2 to either the toe region 4 or the heel region 3. See FIG. 5.

Also further exemplified in FIG. 5, the self-bailing footwear device comprises a toe region 4, a heel region 3, an insole board 2 extending from the heel region 3 to toe region 4 with at least one compressible pump 12, at least one fluid flow channel 14 having a fluid reservoir 35, an inlet 15 and an outlet 16 and extending at least from the heel region 3 to the toe region 4, and at least one check valve 17 located between the inlet 15 and the outlet 16 to control fluid flow direction. The compressible pump 12 used in this exemplary self bailing footwear device expels fluid through a fluid outlet. The outlet 16 may be located in any desired position on the footwear. The inlet 15 of the fluid flow channel 14 is in fluid communication with the pump 12 so that fluid can be drawn into the fluid reservoir 35 of the fluid flow channel 14 through the inlet 15 upon decompression of the pump 12. The outlet 16 of the fluid flow channel 14 is located so that fluid is expelled from the footwear article to the external environment through the outlet 16 of the fluid flow channel 14 upon compression of the pump 12.

In one embodiment, the outlet 16 of the fluid flow channel 14 is a single opening, although it can have a plurality of openings.

Preferably the compressible pump used in this embodiment of the present invention withstands at least one million compressions before failure. In some embodiments of this footwear device, the compressible pump is comprised of at least two dissimilar materials, for example a polyurethane may be joined to a polyethylene, a polyvinyl chloride may be joined to a TPU, or some other material combination of desired materials may be assembled.

In one aspect, the embodiments of the present invention may further comprise air conditioning means present within the air flow channel. Such air conditioning means include but are not limited to: perfumes, deodorants, heat packs, antimicrobial additives and other desired conditioners. It is also possible to incorporate fluid conditioning means into the fluid flow channel such as perfumes, deodorants, heat packs, antimicrobial additives and other desired conditioners.

In yet another embodiment, a hybrid bailing-ventilating footwear device of the present invention comprises ventilating system of a toe region 4, a heel region 3, an insole board 2 which extends from the heel region 3 to the toe region 4 of the footwear device, at least one resilient, pivotable pump 7, at least one fluid flow channel 14 having an inlet 15 and an outlet 16 which also extends from the heel region 3 to the toe region 4 of the footwear device 20, and at least one check valve 17 located within the fluid flow channel 14 between the inlet 15 and the outlet 16. In addition, the footwear comprises bailing system of a waterproof upper 30, a waterproof sole region, and a fluid distribution system 32 having at least one inlet 15 connected to at least one compressible pump 12 connected to or integrated with a fluid reservoir 35. The wearer of the hybrid bailing-ventilating footwear device may choose to have the device operate as either a bailing device or a ventilating device by modulating the device in a manner so as to enable either the bailing system or alternatively the ventilating system.

EXAMPLES

Example 1

To measure performance in samples, an air collection/measurement device consists of the following: an inverted funnel is submerged in a large water bath, and an inverted graduated cylinder is placed on top of the funnel, with the open end of the graduated cylinder under water. Each airflow/pump device is tested in the following way: the airflow device is placed in the water bath with the air inlet above the waterline and the air outlet submerged and directly below the wide end of the funnel; the airflow device is pumped manually, and the air flows through the device, through the funnel, and is collected in the inverted graduated cylinder.

A series of fluid expulsion pumps were utilized, and the total displaced volume of air collected in the graduated cylinder is divided by the total number of pumps to determine the amount of air expelled from the airflow device per pump.

Samples B, C, and D were comparative examples using standard footwear pump-like components for air flow. The footwear was broken down into its core components to more clearly read displacement capability. The samples' pump assemblies were then used directly to collect the data for the sample as shown in Table 1A.

Example 2

Tables 1A and 1B show the total volume displacement for the samples tested in Example 1 above.

DATA-TABLE 1A

| Displacement trial # | Inventive prototype displacement in ml | Sample B system displacement in ml |
|---|---|---|
| 1 | 15 | 4 |
| 2 | 16 | 4 |
| 3 | 19 | 4 |
| 4 | 23 | 4 |
| 5 | 17 | 5 |
| 6 | 18 | 5 |
| 7 | 19 | 4 |
| 8 | 21 | 4 |
| 9 | 21 | 4 |
| 10 | 21 | 4 |
| 11 | 21 | 5 |
| 12 | 20 | 5 |
| 13 | 20 | 4 |
| 14 | 20 | 4 |
| 15 | 21 | 4 |
| 16 | 22 | 4 |
| 17 | 23 | 4 |
| 18 | 22 | 5 |
| 19 | 21 | 4 |
| 20 | 24 | 4 |
| Avg displacement | 20.20 | 4.25 |

TABLE 1B

| Sample C displacement in ml | Sample D displacement in ml | Displacement trial # |
|---|---|---|
| 4 | 1 | 1 |
| 4 | 2 | 2 |
| 4 | 1 | 3 |
| 4 | 1 | 4 |
| 3 | 1 | 5 |
| 3 | 1 | 6 |
| 5 | 1 | 7 |
| 5 | 2 | 8 |
| 3 | 1 | 9 |
| 4 | 1 | 10 |
| 4 | 1 | 11 |
| 3 | 1 | 12 |
| 5 | 1 | 13 |
| 5 | 1 | 14 |
| 4 | 2 | 15 |
| 4 | 1 | 16 |
| 4 | 1 | 17 |
| 4 | | 18 |
| | | 19 |
| | | 20 |
| 4.00 | 1.176 | Avg displacement |

Example 3

What is meant by "Waterproof footwear" is determined as follows. The footwear is placed on top of a piece of blotter paper. The inside of the footwear is filled with room temperature water to a height of about 30 mm (measured from the insole at the heel area of the footwear). The water is allowed to stand in the footwear for two hours. At the end of the two hour period the blotter paper and footwear upper are examined to determine if water has reached the blotter paper or the outer layer of the upper. If no water has reached the blotter paper or the outer layer of the upper, then the footwear is waterproof.

Example 4

As used herein the "waterproof, water vapor permeable functional layer" and the "waterproof gasket material" are "waterproof" if, when combined to form the footwear according to the invention, they result in the footwear being "waterproof" as defined above.

Example 5

A shoe fitted with an airflow pump device is placed on a walking simulator. An air collection/measurement device is placed nearby and consists of a large graduated cylinder, partially filled with water and also containing a smaller, inverted graduated cylinder floating in the water. One end of a tube is placed on the outlet of the airflow device, and the other end runs into the large graduated cylinder, under the waterline and into the smaller, inverted graduated cylinder. As the walking simulator "walks", the airflow device's pump is compressed, and the air passes through the outlet, through the tube and into the air collection/measurement device, causing the smaller, inverted graduated cylinder to rise in the water. A series of steps is counted, and the total air volume displacement in the smaller, inverted graduated cylinder is divided by the number of steps taken to determine the volume of air expelled from the airflow device per step.

Example 6

An air collection/measurement device consists of the following: an inverted funnel is submerged in a large water bath, and an inverted graduated cylinder is placed on top of the funnel, with the open end of the graduated cylinder under water. Each airflow/pump device is tested in the following way: the airflow device is placed in the water bath with the air inlet above the waterline and the air outlet submerged and directly below the wide end of the funnel; the airflow device is pumped manually, and the air flows through the device, through the funnel, and is collected in the inverted graduated cylinder. A series of pumps is made, and the total displaced volume of air collected in the graduated cylinder is divided by the total number of pumps to determine the amount of air expelled from the airflow device per pump.

Example 7

As shown in Table 2 below, a casual shoe was modified to allow the delivery of air at the toe. The humidity of the ventilating air was the same as ambient relative humidity (RH). Temperature and relative humidity was monitored at 3 sites, instep, sole, heel. During each trial the weight change of the shoe and sock was measured. The duration of each trial was one hour. The flow of air through the footwear was regulated at: 0, 5, 10, 20, 30, 60, 90 ml/stride positive airflow, and 5, 10, 20, 30 ml/stride negative airflow. Stride frequency (cadence) was simulated at 2 Hz (fast walking pace).

Data logging equipment was attached to the body (i.e.: attach T and RH sensors to three sites on foot; attach memory card to leg) and put on inventive shoe on foot, non-inventive shoe on the other foot. In the case of this test, simply perform normal duties in the office for a period of three hours (some walking, some sitting, some standing in conditions ~70 F and 40% RH). Results show significant climate comfort benefit to inventive technology.

TABLE 2

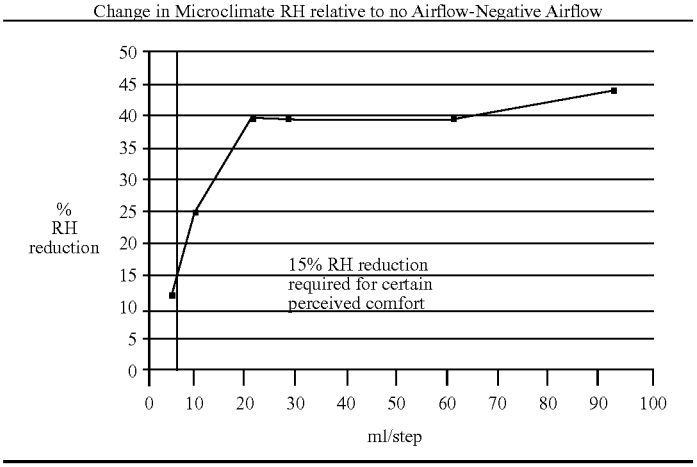

Example 8

As shown in Table 3 below, using the test protocol of Example 7, a microclimate (relative humidity RH) reduction of at least 15% in a system is provided by a system that will deliver greater than 10 ml of expelled fluid volume per step. It is believed that a system which delivers this level of airflow will satisfy most consumers under most environments and activities. Whereas, the delivered air flow above 30 ml/step showed no measurable user benefit under these test conditions.

TABLE 3

Change in Microclimate RH relative to no Airflow-Positive Airflow

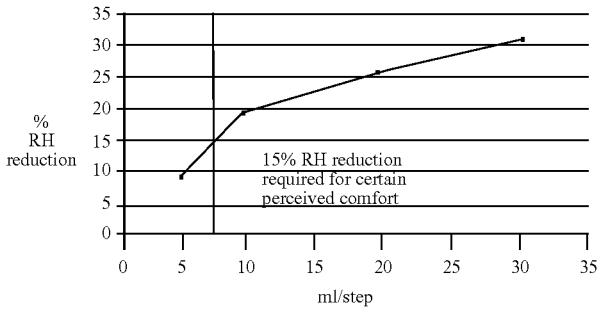

While particular embodiments of the present invention have been illustrated and described herein, the present invention should not be limited to such illustrations and descriptions. It should be apparent that changes and modifications may be incorporated and embodied as part of the present invention within the scope of the following claims.

What is claimed is:

1. A self-ventilating footwear device comprising:

(a) a toe region;

(b) a heel region;

(c) an insole board extending from said heel region to said toe region and having at least one resilient, compressible pump having an expelled fluid volume of at least 10 ml; and (d) at least one fluid flow channel having an inlet and an outlet and extending at least from the heel region to the toe region, wherein the inlet is located proximal to said heel region and in fluid communication with said at least one compressible pump for air to be drawn into the compressible pump through the inlet upon decompression of the pump, and further wherein the the inlet extends through the upper into the external environment.

2. The footwear device of claim 1 wherein the at least one resilient, compressible pump withstands at least 250,000 compressions.

3. The footwear device of claim 1 wherein the at least one resilient, compressible pump withstands at least 500,000 compressions.

4. The footwear device of claim 1 wherein the at least one resilient, compressible pump is comprised of at least two dissimilar materials.

5. The footwear device of claim 1 wherein the at least one resilient, compressible pump has an efficiency rating of at least 50%.

6. The device of claim 1 wherein the outlet is located distal to said toe region and in said at least one fluid flow channel at about said toe region for air drawn into the pump to be expelled through the outlet upon compression of the pump.

7. The device of claim 1 further comprising at least one check valve located within the fluid flow channel between the inlet and the outlet; and wherein said self-ventilating footwear device is configured to fit substantially within a footwear article extending substantially the length of the footwear article.

8. The self-ventilating footwear device of claim 1 further comprising an inlet cover on the inlet of said at least one fluid flow channel.

* * * * *